US008272097B2

(12) United States Patent
Poetting

(10) Patent No.: US 8,272,097 B2
(45) Date of Patent: Sep. 25, 2012

(54) UPRIGHT VACUUM CLEANER

(75) Inventor: Michael Poetting, Bielefeld (DE)

(73) Assignee: Miele & Cie. KG, Guetersloh (DE)

( * ) Notice: Subject to any disclaimer, the term of this patent is extended or adjusted under 35 U.S.C. 154(b) by 1064 days.

(21) Appl. No.: 12/199,411

(22) Filed: Aug. 27, 2008

(65) Prior Publication Data

US 2009/0056057 A1 Mar. 5, 2009

(30) Foreign Application Priority Data

Aug. 30, 2007 (DE) ..... 10 2007 040 959

(51) Int. Cl.
*A47L 5/28* (2006.01)

(52) U.S. Cl. ..... 15/351; 15/346; 15/411

(58) Field of Classification Search ..... 15/346, 15/351, 411; *A47L 5/28*
See application file for complete search history.

(56) References Cited

U.S. PATENT DOCUMENTS

| | | | | |
|---|---|---|---|---|
| 2,672,642 | A * | 3/1954 | Tamarin et al. | 15/323 |
| 2,806,242 | A * | 9/1957 | Sparklin | 15/351 |
| 3,797,064 | A * | 3/1974 | MacFarland | 15/351 |
| 3,932,912 | A | 1/1976 | Johnson | |
| 4,129,920 | A | 12/1978 | Evans et al. | |
| 4,423,534 | A | 1/1984 | Lyman et al. | |
| 5,323,510 | A | 6/1994 | Redding | |
| 5,584,095 | A | 12/1996 | Redding | |
| 5,617,611 | A | 4/1997 | Woerwag | |
| 5,794,305 | A | 8/1998 | Weger | |
| 6,055,703 | A | 5/2000 | Redding | |
| 6,148,473 | A * | 11/2000 | Embree et al. | 15/347 |
| 6,277,164 | B1 * | 8/2001 | Embree et al. | 55/374 |
| 7,159,277 | B2 * | 1/2007 | Steiner et al. | 15/384 |
| 2003/0131440 | A1 | 7/2003 | Illingworth | |
| 2006/0080803 | A1 | 4/2006 | Stein | |
| 2009/0056058 | A1 | 3/2009 | Finke et al. | |
| 2009/0056059 | A1 | 3/2009 | Mersmann et al. | |
| 2009/0056063 | A1 | 3/2009 | Poetting | |
| 2009/0056068 | A1 | 3/2009 | Iseringhausen et al. | |

FOREIGN PATENT DOCUMENTS

| | | |
|---|---|---|
| DE | 195 25 796 A1 | 1/1997 |
| EP | 0708613 | 5/1996 |
| EP | 0909546 | 4/1999 |
| EP | 1647219 A2 | 4/2006 |

(Continued)

OTHER PUBLICATIONS

European Search Report of EP 08 01 4677, dated Sep. 29, 2011.

(Continued)

*Primary Examiner* — David Redding
(74) *Attorney, Agent, or Firm* — Leydig, Voit & Mayer, Ltd.

(57) ABSTRACT

An upright vacuum cleaner for cleaning a surface includes an upper body having a dust collection container received therein, a base unit and a carriage configured to provide movement of the base unit on the surface. A motor-fan unit is disposed in the base unit and configured to create a partial vacuum at the surface. A rigid, yoke-shaped duct member provides at least a portion of an air path from the base unit to the upper body. The yoke-shaped duct member supports the upper body such that the upper body is pivotable relative to the base unit about a tilt axis extending horizontally when the upright vacuum cleaner is in a position of use.

3 Claims, 9 Drawing Sheets

FOREIGN PATENT DOCUMENTS

| | | | |
|---|---|---|---|
| EP | 1782724 | | 5/2007 |
| GB | 2422094 | A | 7/2006 |
| WO | WO 0059360 | A1 | 10/2000 |
| WO | WO-0228257 | | 4/2002 |
| WO | WO-2004014209 | | 2/2004 |
| WO | WO-2007008770 | | 1/2007 |

OTHER PUBLICATIONS

European Search Report of EP 08 01 4412, dated Jul. 11, 2011.

* cited by examiner

UPRIGHT VACUUM CLEANER

CROSS REFERENCE TO RELATED APPLICATIONS

Priority is claimed to German patent application DE 10 2007 040 959.3, filed Aug. 30, 2007, which is hereby incorporated by reference herein.

FIELD

The present invention relates to a vacuum cleaner of the upright type, including an upper body which contains a dust collection container and is provided with a handle and including a base unit with a motor-fan unit which is located in the base unit.

BACKGROUND

The following is a description of three types of vacuum cleaners which differ in design and operation. All of them have as common features a motor-driven fan, a dust collection chamber, and one or more floor treatment devices which are each adapted for a particular purpose.

The canister vacuum cleaner has a housing which can be moved on the floor to be cleaned on wheels and/or runners. The housing contains the motor-fan unit and the dust collection container. The floor treatment device, here referred to as floor nozzle, is connected to the dust collection chamber via a suction hose, and possibly a suction wand connected therebetween. During vacuuming, the housing is moved to the desired position by pulling on the suction wand.

In a stick vacuum cleaner, the motor-fan unit and the dust collection container are also disposed in a housing. A suction wand extends from one end of the housing, connecting the floor nozzle to the dust collection container, and a handle used to maneuver the housing to the desired position extends from the other end.

Uprights do not have as strictly divided a configuration as the two aforementioned types. One feature of an upright is a movable base unit which carries an upper body containing a large dust collection container. The two parts are tiltable relative to each other and can usually be locked in a parked position in which the upper body is nearly upright when the base unit is located on a horizontal floor in a position of use. In this position, the upright stands unsupported. During vacuuming, the above-described locked engagement is released, and the upper body is tilted through a certain angle to an operating position. The tilt angle depends on the height of the user and on the particular purpose of use. A handle is provided on the upper body for maneuvering the entire appliance. The motor-fan unit may be mounted at different locations. WO 2007/008770 A2 describes, for example, securing the fan directly to the upper body. This reduces the ease-of-use because this heavy component produces a torque about the tilt point, which the user must counteract throughout the vacuuming operation. The upright described in WO 2007/008770 A2 has the further drawback is that it is difficult to move from a straight path of travel into a curved path of travel. In WO 2004/014209 A1 and EP 0 708 613 A1, the fan is configured as a separate unit. Providing a point of rotation between the upper body and the upper region of the fan (EP 0 708 613 A1), or mounting the fan in a rotatable, spherical housing (WO 2004/014209 A1) enables the upright to move along curved paths, thereby improving maneuverability. In order for vacuum cleaners to meet the HEPA quality standard, which is required for people with allergies, an exhaust filter capable of retaining ultrafine particles should be disposed downstream of the fan motor. In the aforementioned uprights, because of the movable mounting of the fan, this filter should be disposed either in the upper body or in the area of the base unit. In this connection, it is difficult is to make the air passageway from the fan to the filter so airtight that the ultrafine particles cannot escape therefrom.

Some uprights have the motor-fan unit located in the base unit. In such upright cleaners, the articulated connection between the base unit and the upper body is provided by a hinge-like structure. The air passageway is provided by flexible hoses extending from the base unit to the upper body. The aforesaid hoses touch sharp edges as the upright is moved about, and can easily be damaged. Moreover, these hoses are cost-creating components which are difficult to install.

SUMMARY

An aspect of the present invention is to provide an upright vacuum cleaner that is rugged and yet simple in construction and easy to manufacture.

The present invention provides an upright vacuum cleaner for cleaning a surface. The upright vacuum cleaner includes an upper body having a dust collection container received therein, a base unit and a carriage configured to provide movement of the base unit on the surface. A motor-fan unit is disposed in the base unit and configured to create a partial vacuum at the surface. A rigid, yoke-shaped duct member provides at least a portion of an air path from the base unit to the upper body. The yoke-shaped duct member supports the upper body such that the upper body is pivotable relative to the base unit about a tilt axis extending horizontally when the upright vacuum cleaner is in a position of use.

BRIEF DESCRIPTION OF THE DRAWINGS

An exemplary embodiment of the present invention will be described in more detail below and is shown schematically in the drawings, in which.

DETAILED DESCRIPTION

The present invention relates to a vacuum cleaner of the upright type, including an upper body which contains a dust collection container and is provided with a handle, and further including a base unit, a carriage permitting said base unit to move on the surface to be cleaned, and a motor-fan unit which is located in the base unit and used for creating a partial vacuum to act on the surface to be cleaned, the upper body and the base unit being tiltable relative to each other about an axis extending horizontally in a position of use.

In an embodiment, the present invention includes a rigid, yoke-shaped duct member which provides a portion of the air path from the base unit to the upper body and which, in addition to providing the air passageway, supports the upper body in such a manner that it is pivotable with respect to the base unit. The functional equivalence of the air path and the mechanical support allows for a sturdy, space-saving design that is easy to manufacture. A tilt and swivel joint is created by an additional axis of rotation so as to enable the base unit to be moved through curves by twisting the upper body or a handle attached thereto. To this end, the duct member enables the upper body to be supported in such a manner that it can not only tilt, but also rotate with respect to the moving base unit.

The two air conduits in the ends of the duct member may be combined into a coaxial conduit in the transition region to the upper body. Thus, the problem of providing two separate air ducts in the region of a swivel joint is solved in a simple way.

The upright vacuum cleaner shown in different views in FIGS. 1 through 6 (hereinafter abbreviated as upright 1) essentially includes a base unit 2, an upper body 3, and a joint disposed therebetween, which will be described in greater detail further on in this specification.

Figure 3:
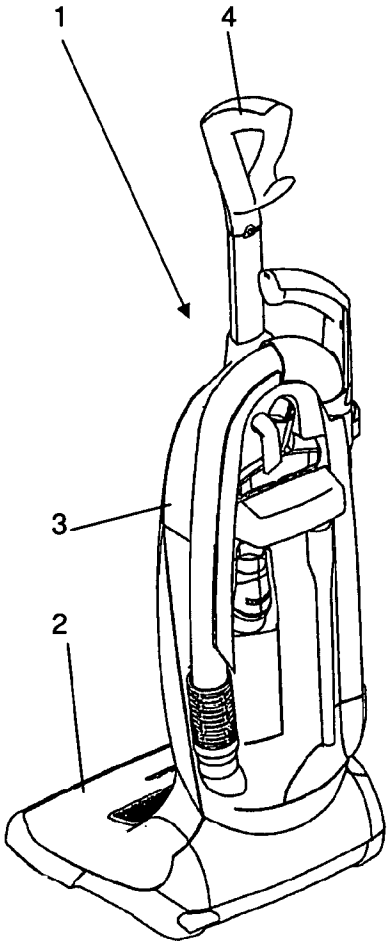
FIGS. 1 through 6 show various overall views of the vacuum cleaner of the present invention.
Figure 2:
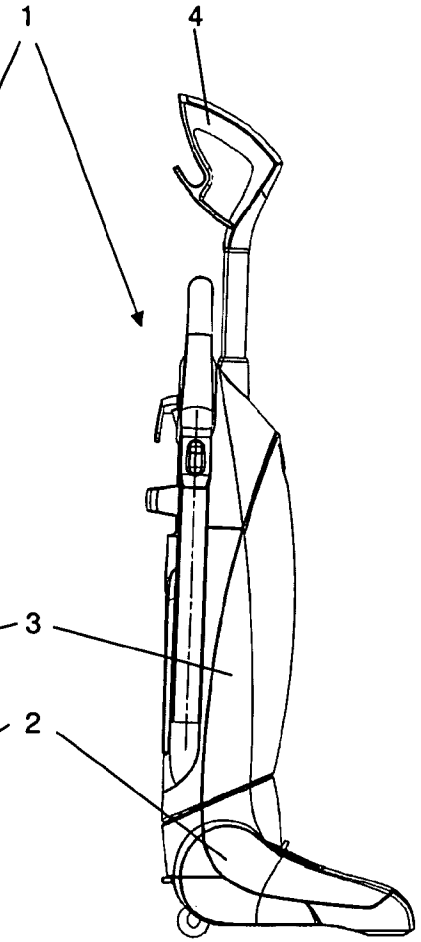
Figure 1:
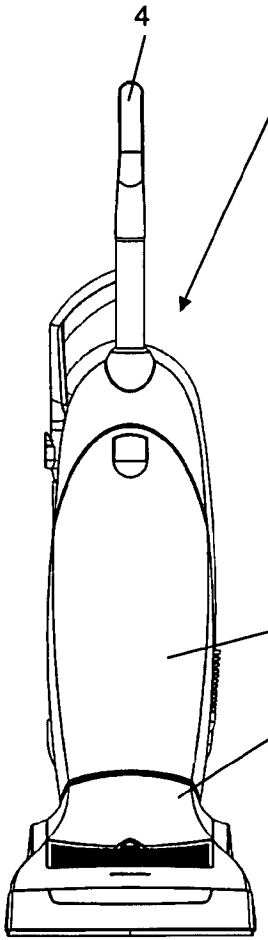
Figure 4:
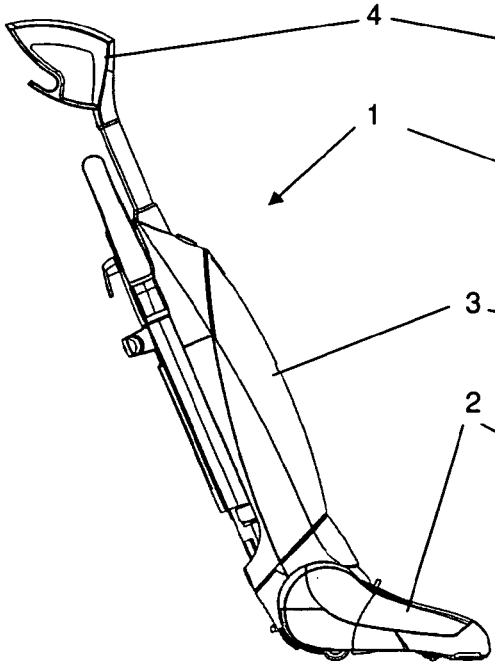
Figure 5:
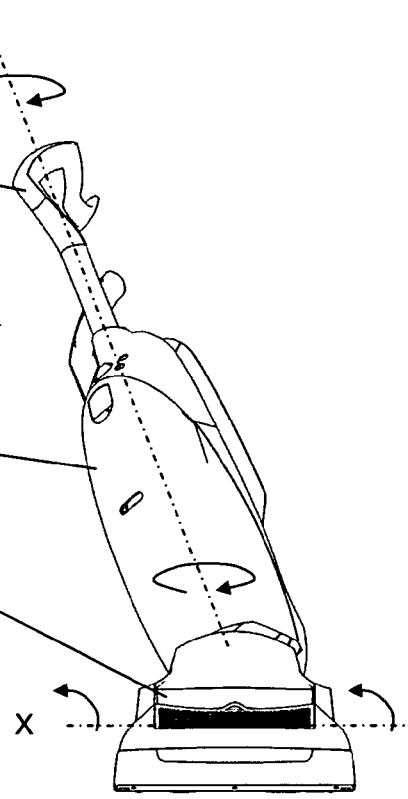
Figure 6:
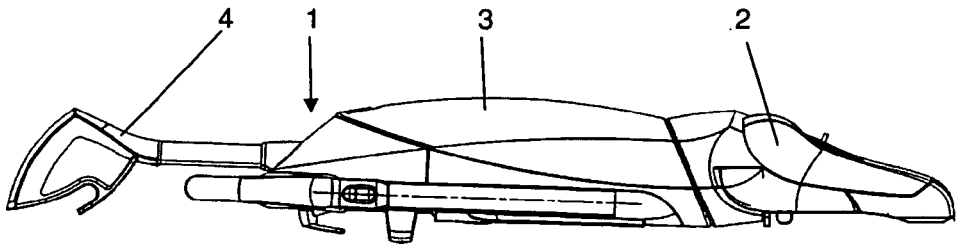
Figure 7:
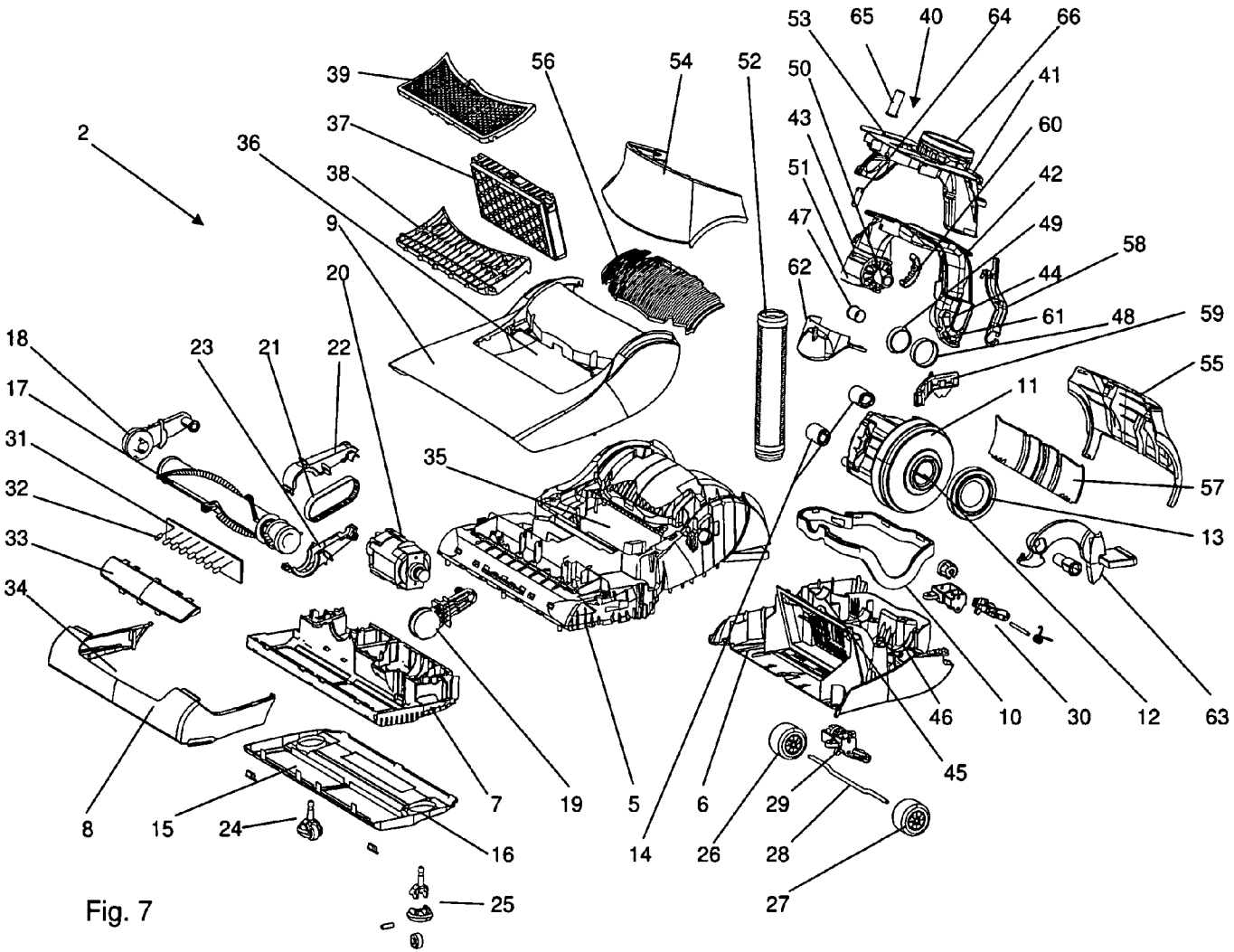
FIG. 7 is an exploded view showing the base unit of the vacuum cleaner.

Upright 1 can be brought from an upright position (see FIGS. 1 through 3), in which it can be locked and stand unsupported, to a tilted position (FIGS. 4 and 5), or even to a fully flat position (FIG. 6), after the locked engagement has been released (see FIG. 7). To this end, base unit 2 and upper body 3 are connected in such a manner that they can be tilted relative to each other about an axis X extending horizontally in a position of use (see FIG. 5). This pivoting movement is made possible by a joint which is hereinafter referred to as "tilting joint". In the tilted position, the upright can be rotated about an axis Y, as is also shown in FIG. 5. The user can maneuver base unit 2 through curves by rotating upper body 3 about the aforesaid axis using handle 4 while simultaneously pulling or pushing the upright. The corresponding joint is hereinafter referred to as "swivel joint".

Base unit 2, shown in the exploded view of FIG. 7, has a housing including a housing insert 5, a lower rear housing part 6, a lower front housing part 7, a bumper strip 8, and a cover part 9. Housing insert 5 functions as a support for a number of electrical and mechanical components. The aforementioned housing parts are also attached thereto. The housing insert, lower rear housing part 6, and a motor chamber seal 10 placed therebetween, together form a chamber for receiving a motor-fan unit 11 for creating the partial vacuum required for vacuuming. A sealing ring 13 is provided around fan inlet 12 on the suction side, said sealing ring also bearing against the two aforementioned housing parts 5 and 6. Rubber buffers 14 are inserted on the opposite side. For deep cleaning of carpets, a brush roller 17 extends into suction mouth 15, which is an opening in lower front housing part 7 and bottom plate 16, which is attached thereto, said brush roller being resiliently mounted on two lateral pivoting arms 18 and 19 and being driven by a brush motor 20 via a belt 21. A two-part belt cover is provided by parts 22 and 23. Brush motor 20 is also attached to housing insert 5, and pivoting arms 18 and 19 are pivotably secured thereto. The carriage of the upright is formed by front casters 24 and 25 and rear wheels 26 and 27 and is supported by the two lower housing parts 6 and 7. Rear wheels 26 and 27 are connected by an axle 28 for purposes of stability, and are adjustable in position by means of a wheel mechanism 29 and 30, respectively. A circuit board 31 carrying LEDs 32 is secured to housing insert 5 to illuminate the travel path and is covered at the front by a transparent plate 33. Transparent plate 33 is held in a cut-out 34 in bumper strip 8.

The air generated by the motor-fan unit 11 is discharged into the environment through an opening 35 in housing insert 5 and a corresponding opening 36 in cover part 9. A filter frame 37 is inserted into opening 36 to hold an exhaust filter for removing ultrafine particles from the exhaust air. Filter frame 37 is covered by a grating holder 38 and a grating 39 within cover part 9, from where it can be replaced.

Both the tilting joint and the swivel joint between base unit 2 and upper body 3, which will be described in greater detail hereinafter, are provided by a rigid, yoke-shaped duct member. This member also contains portions of the air passageway from suction mouth 15 to upper body 3, and the air passageway from upper body 3 to the exhaust port (openings 35 and 36). This member is hereinafter referred to as yoke 40. It is shown isolated in FIGS. 10 and 12, while in FIGS. 9 and 9*a*, it is shown in the installed position. The yoke-shaped duct member is formed by two plastic parts, an upper shell 41 and a lower shell 42, which are welded together. In order to create the tilting joint, the two ends 43 (right) and 44 (left) of yoke 40 are pivotably mounted in openings 45 and 46 provided for this purpose, and are surrounded by metal bearing sleeves 47 and 48, respectively, in order to avoid wear. Yoke end 44, which is on the left side as viewed in the direction of travel, is hollow and is coupled to fan inlet 12 via a seal 49. A trunnion 50 is integrally formed with yoke end 43, which is on the right side as viewed in the direction of travel. Moreover, the right yoke end has an opening 51 which is connected by a flexible tube 52 to suction mouth 15. In order to prevent the interior of base unit 2 from becoming visible when tilting the upper body 3, the connecting portion between the two yoke ends 43 and 44 (hereinafter referred to as bridge portion 53) is enclosed by a front cover 54 and a rear cover 55, which are provided on base unit 2 and are capable of following the swivel motion of yoke 40. The gap between the front and rear covers and housing insert 5 is bridged by covering members 56 and 57. The first 58 of two cable ducts 58 and 59 is attached to left yoke end 44. Furthermore, yoke ends 43 and 44 carry toothed segments 60 and 61, which cooperate with wheel mechanisms 29 and 30. A covering cap 62 for a connecting cable is secured to bridge portion 53. To enable the upright to be locked in the upright position (FIGS. 1 through 3), a foot pedal 63 is mounted on housing insert 5 which, in this position, engages with left yoke end 44, thereby preventing yoke 40 from swiveling. The locked position can be released by depressing pedal 63. Moreover, in the locked position, swivel motion is prevented by two spring-mounted pins 64 and 65. In the region of bridge portion 53, the air passages provided by yoke ends 43 and 44 are combined into a first section 66 of a coaxial conduit.

Figure 8:
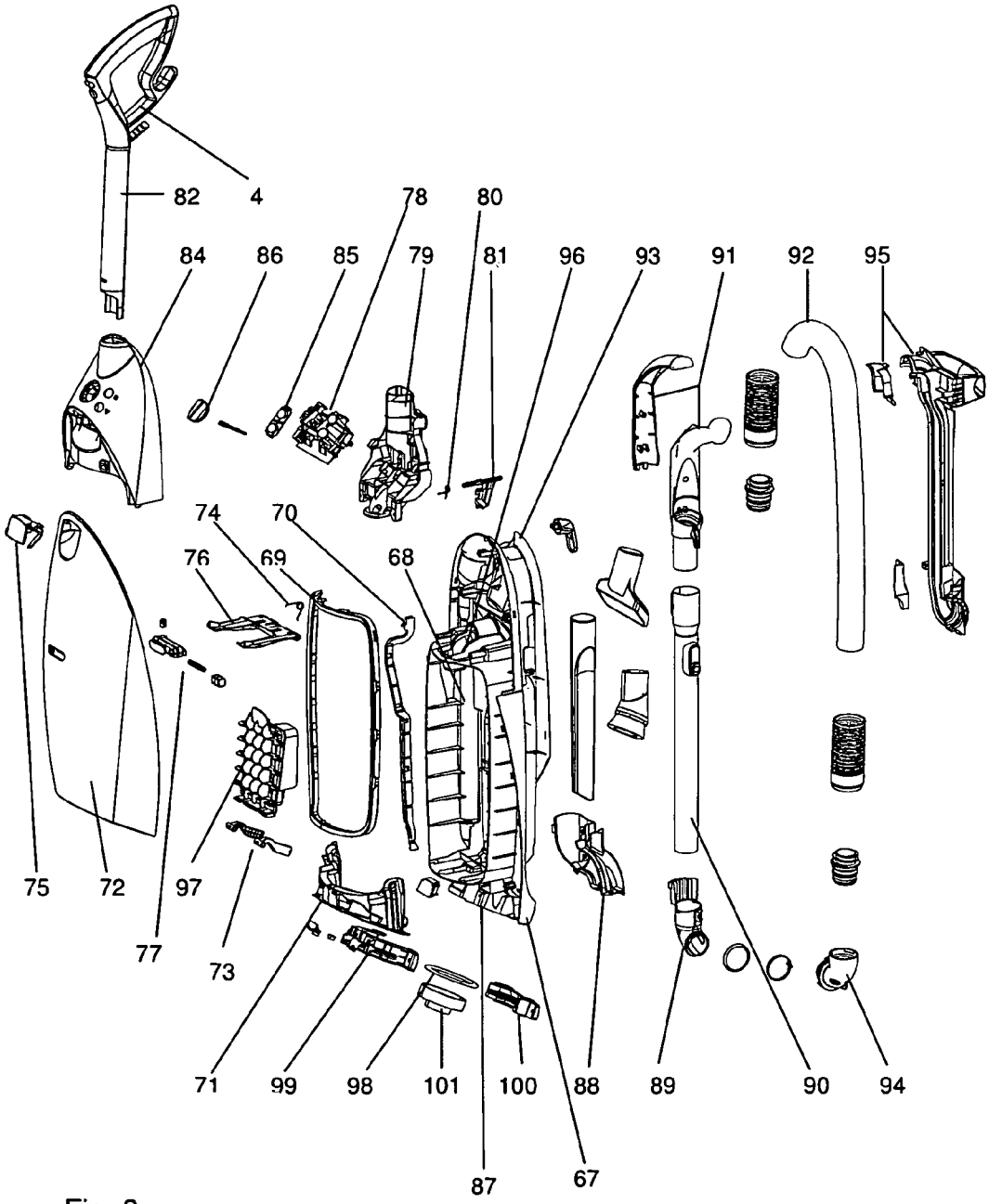
FIG. 8 is an exploded view illustrating the upper body of the vacuum cleaner.

FIG. 8 shows upper body 3, also in an exploded view. The load-bearing part of upper body 3 is a rear wall 67. The aforesaid rear wall forms the rear portion of dust chamber 68, which in turn receives a filter bag. A seal 69 surrounds the edge of dust chamber 68, and a covering strip 70 for cables is attached at the side. A hinge bearing 71 is secured to rear wall 67 in the lower portion thereof. Dust chamber 68 is closed at the front by an upper housing part 72 which is pivoted to hinge bearing 71 by hinges 73 and torsion springs 74. Upper housing part 72 carries a locking device 75, a dust bag holder 76, and a filter replacement indicator 77 and, in addition, serves to cover hinge bearing 71. In the upper portion, rear wall 67 carries the electronics 78 of the upright, which are completely arranged on a holder 79 and can be installed as a pre-tested subassembly. A lever 81 for turning off brush motor 20 is mounted to the holder via a torsion spring 80. In addition, said holder is used to hold handle tube 82 and appliance handle 4.

Electronics 78 are covered by a cap 84, which also serves for attachment of various controls and indicators and accessories thereof (transparent cover 85, rotary knob 86).

An air path system allows dirt-laden air to be optionally sucked in either through the suction mouth in the base unit or through a telescoping wand to which may be attached vacuum attachments such as a crevice tool, a dusting brush, an upholstery tool, etc. To this end, the suction air is directed from suction mouth 15 through flexible tube 52 and right yoke end 43, and further through the inner tube of first section 66 of the coaxial conduit in bridge portion 53 into the inner tube of a second section 87 of the coaxial conduit. This section 87 is continued in rear wall 67, where it is divided into two separate conduits. The air path continues through a suction duct member 88 into an elbow 89. A telescoping wand 90 is loosely, and therefore removably, inserted into elbow 89. The aforesaid telescoping wand merges into a wand handle 91 and further into a flexible suction hose 92. Suction hose 92 is held in a receiving structure 93 provided for this purpose, as can be seen also in FIG. 3. The air passes through a swivel elbow 94 into a duct which extends along the entire length of rear wall 67. The duct is defined by rear wall 67 itself and an air duct member 95 placed thereon. A downstream, elbow-shaped duct member 96, which is formed by rear wall 67 and a portion of electronics holder 79, directs the dirt-laden suction air into the region of dust bag holder 76, and there into a dust bag. Once the suction air has passed through the dust bag in the dust chamber and been cleaned of dust therein, it passes through a motor protection filter (the figure shows only the frame 97 for holding the filter) and into the outer annulus of second section 87 of the coaxial conduit, and from there through first section 66 and left yoke end 44 to motor-fan unit 11.

The lower portion of FIG. 8 further shows the components used for attaching and rotatably supporting upper body 3 on yoke 40. First section 66 of the coaxial conduit is surrounded by a metal ring 98 which is enclosed by injection-molded material and projects beyond the outside diameter of said section 66, and which is held around its circumference in two bearing shells 99 and 100. Bearing shells 99 and 100 are connected to upper body 3. Accordingly, metal ring 98 and bearing shells 99 and 100 together form the swivel joint of upright 1. When joining upper body 3 and yoke 40, the two sections 66 and 87 of the coaxial conduit are joined together with a seal 101 interposed therebetween.

Figure 9:
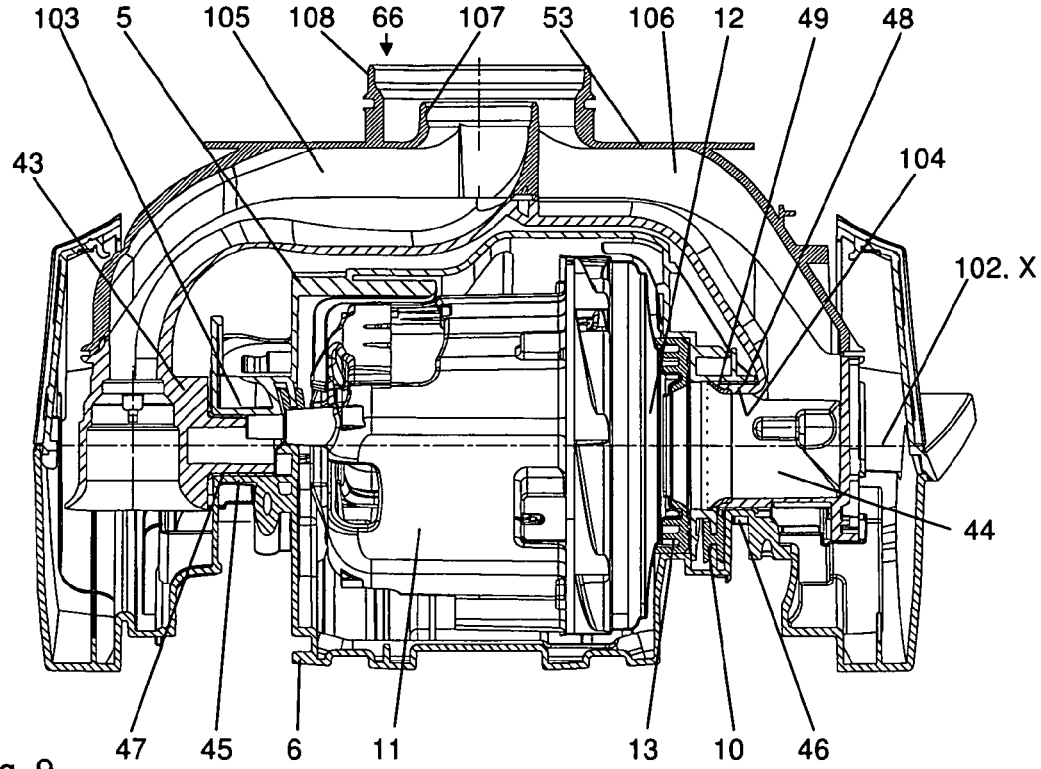
FIGS. 9 and 9*a* are longitudinal cross-sectional views of the yoke and parts of the base unit of the vacuum cleaner shown in FIG. 1.
Figure 9A:
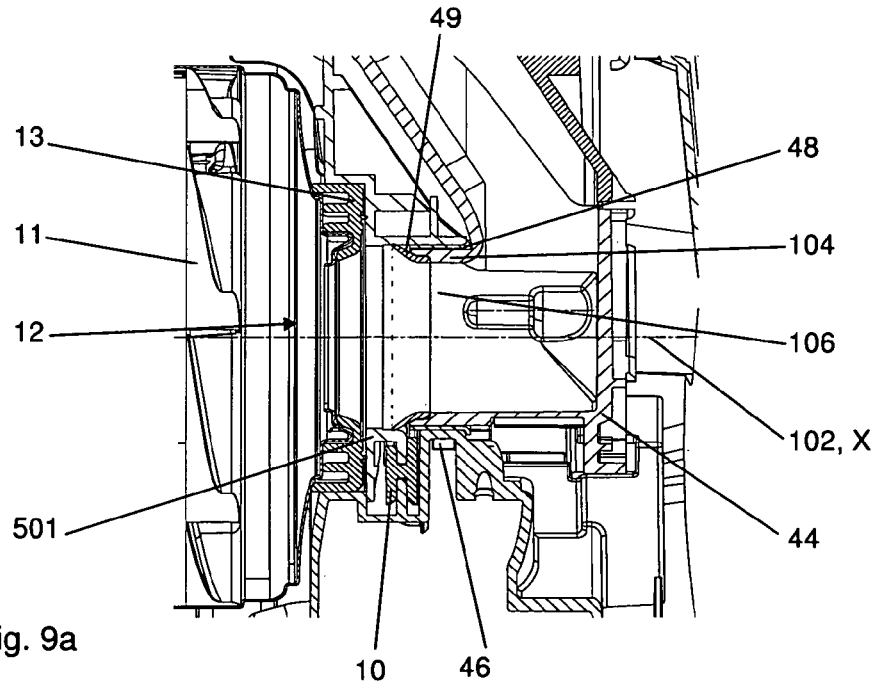

In FIG. 9, there can be seen the motor-fan unit 11, which is placed in lower rear housing part 6 and covered by housing insert 5. As already described above, motor chamber seal 10 enables these two components to be connected in an airtight manner because of its H-shaped cross-section. Sealing ring 13 is provided around fan inlet 12 on the suction side, said sealing ring also bearing against the two aforementioned housing parts 5 and 6. The enlarged view of FIG. 9*a* shows that housing insert 5 merges into a sleeve-shaped projection 501 in the region of fan inlet 12. This avoids points of abutment between the two housing parts in this region. As already described above, yoke end 43, which is on the right side as viewed in the direction of travel (out from the plane of the drawing and shown to the left in FIG. 9), is formed as a trunnion and surrounded by a metal bearing sleeve 47. The aforesaid trunnion is supported in an enclosed bearing seat which is formed by opening 45 and a mating opening 103 of housing insert 5 when mounting lower rear housing part 6. Also shown in FIG. 9 is opening 51 into which is inserted the flexible tube member that connects to suction mouth 15 (see FIG. 7). Yoke end 44, which is on the left side as viewed in the direction of travel (shown to the right in FIG. 9), provides both the air passageway from the upper body to the suction side of fan 11 (fan inlet 12) and the point of rotation for the tilting joint. Therefore, it is hollow and is provided with a seal 49 at its end. Seal 49 bears against projection 501 and provides an airtight passage between fan 11 and yoke end 44. This makes it possible to achieve high suction power. As with the right yoke end, the mounting is provided by a bearing sleeve 48 which is supported in a bearing seat (openings 46 and 104). Axis of rotation X extends along the axis of symmetry of motor-fan unit 11 and is shown as a dashed line 102.

Figure 10:
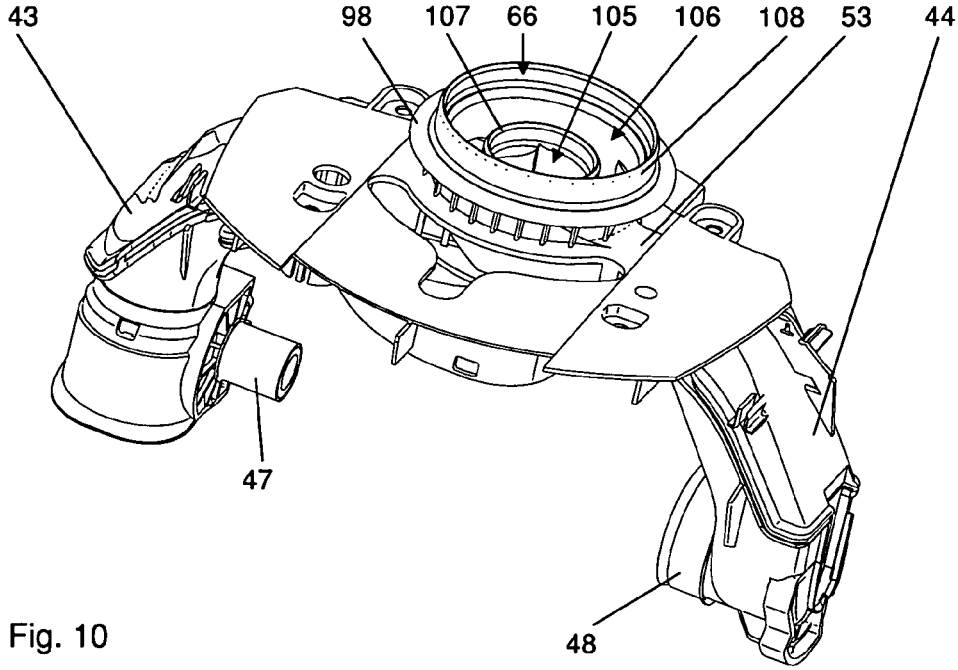
FIGS. 10 and 11 are isolated perspective views of the yoke.
Figure 11:
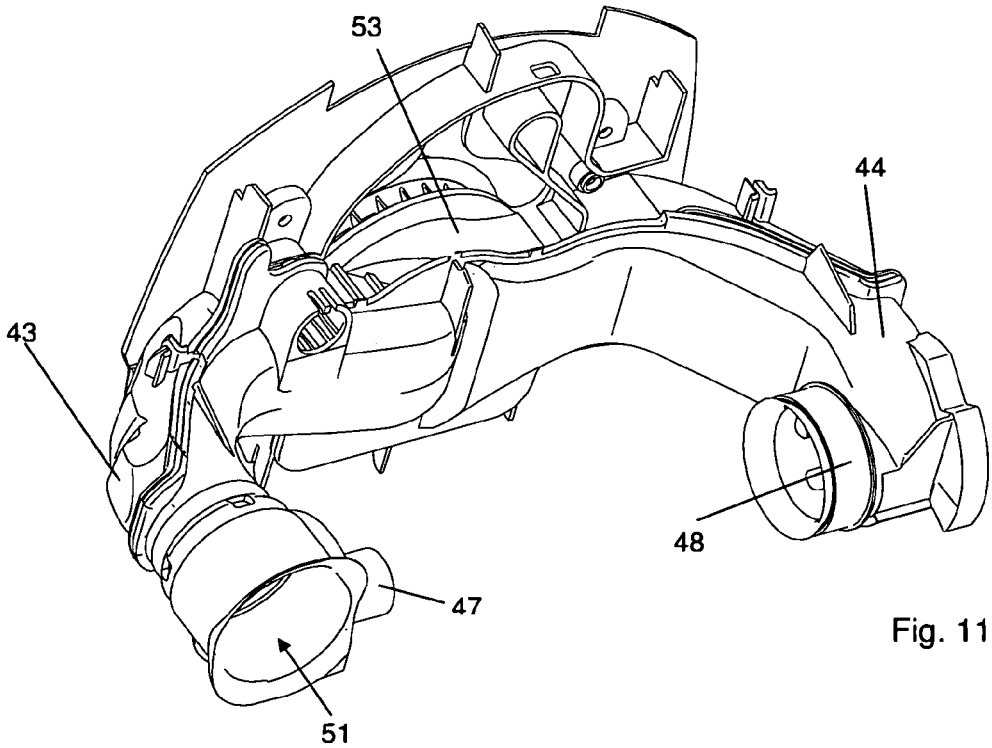

FIGS. 9 through 11 also show bridge portion 53, in which the two air conduits 105 and 106 from yoke ends 43 and 44 are combined into a first section 66 of a coaxial conduit. This is shown particularly well in FIGS. 9 and 10. Air conduit 105, which is provided by right yoke end 43, is routed into upper body 3 as an inner tube 107. This tube 107 has a large cross-sectional flow area, allowing the dirt-laden air and also larger debris to easily pass therethrough. Conduit 106, which is provided by left yoke end 44, surrounds inner tube 107 within bridge portion 53 and is routed into upper body 3 as an outer annulus 108. This is advantageous because the air conveyed therein has already been cleaned and can therefore be passed through this region of smaller cross-sectional flow area.

Figure 12:
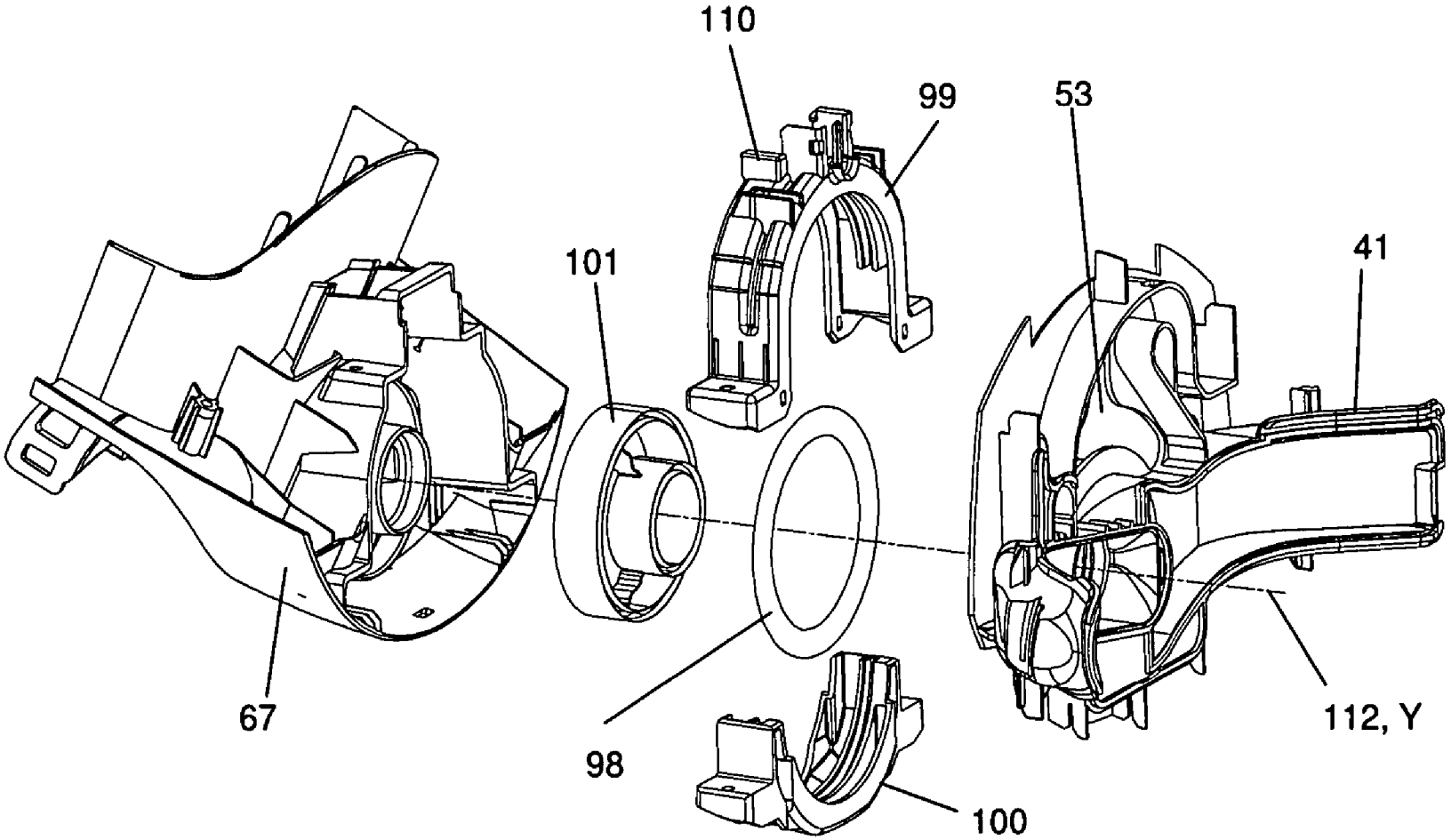
FIG. 12 is an exploded view from below of the vacuum cleaner components in the region of the swivel joint.
Figure 13:
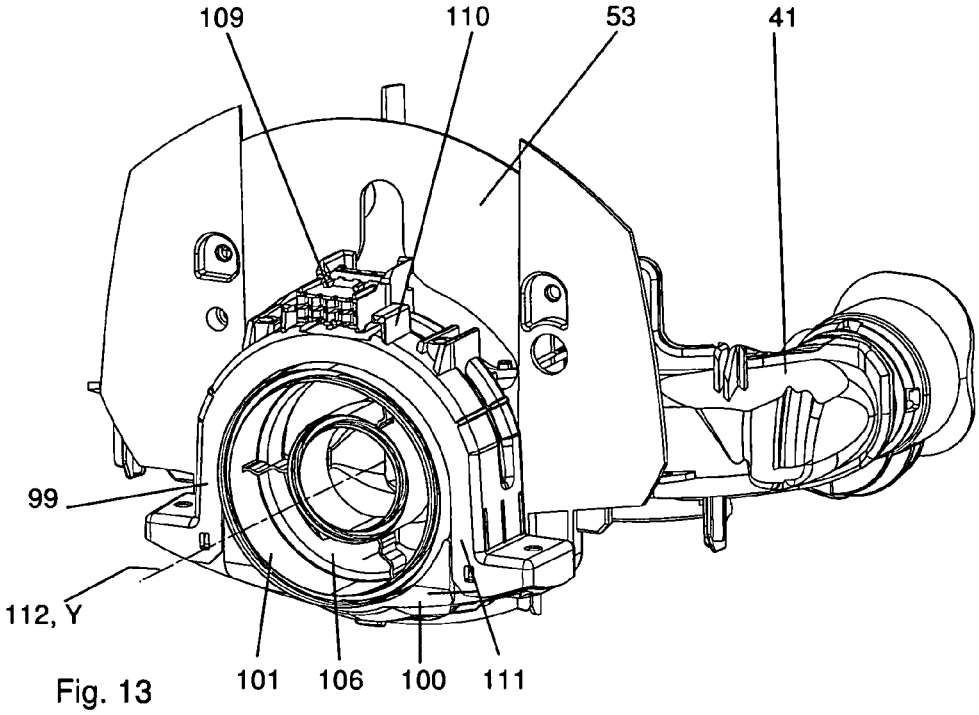
FIG. 13 is a view showing the upper shell of the yoke along with the bearing housing and the seal.

FIGS. 12 through 16 are various views showing the transition region from yoke 40 to upper body 3. It is apparent that the bridge portion 53 of upper shell 41 and rear wall 67 are not joined until the two subassemblies, base unit 2 and upper body 3, are fully assembled. As already described above, outer tube conduit 106 of the coaxial conduit section at bridge portion 53 is surrounded by a metal ring 98 which is enclosed by injection-molded material. FIG. 10 shows the outer tube with ring 98 in an installed condition. Initially, coaxial seal 101 is placed on inner tube conduit 105 and outer tube/annulus conduit 106. Then, the two bearing shells 99 and 100 are joined together around outer tube conduit 106 and metal ring 98 by means of screws (not shown), forming a bearing housing 111. A plug connector 109 connected by wires to the electrical loads in the base unit is snapped into a connector holder 110 on upper bearing shell 99. In FIG. 13, upper shell 41 is shown after completion of these assembly steps, and must be imagined to be completed with the remaining components of base unit 2. Bearing housing 111 is dimensioned such that it can be rotated about outer tube/annulus conduit 106 and metal ring 98, thereby providing an axis of rotation Y, which is shown in FIGS. 12 through 16 as a dashed line 112.

Figure 14:
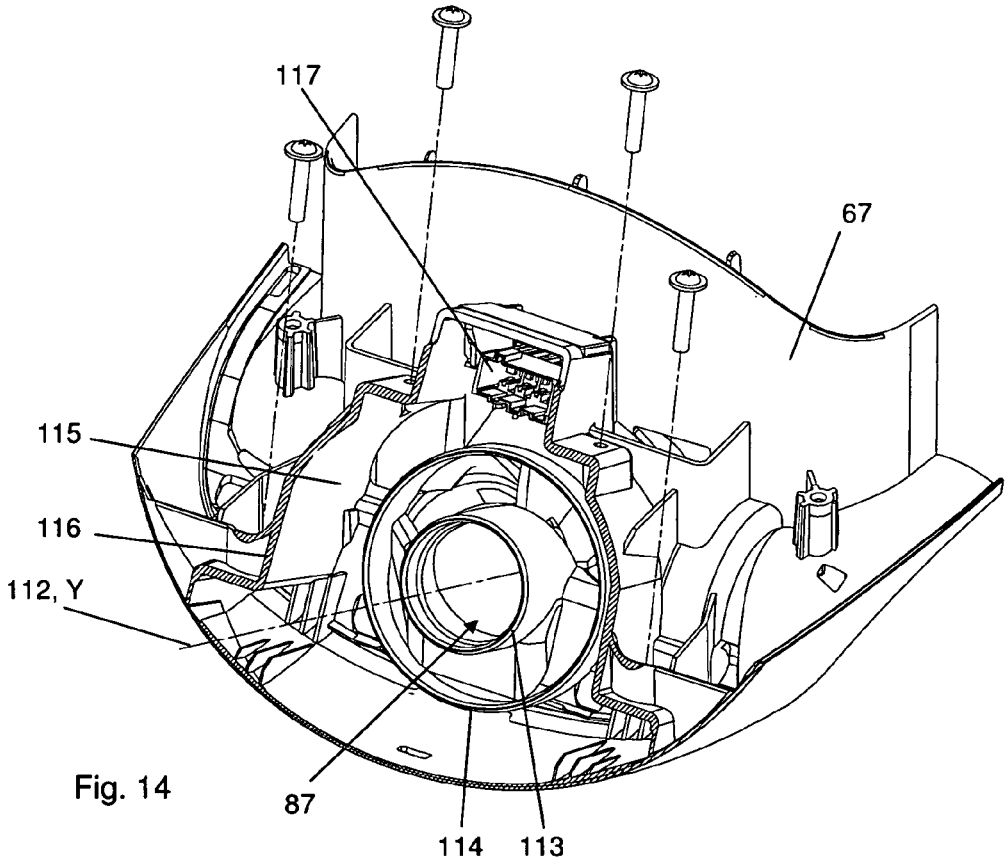
FIG. 14 is a view showing the rear wall of the upper body from below.
Figure 16:
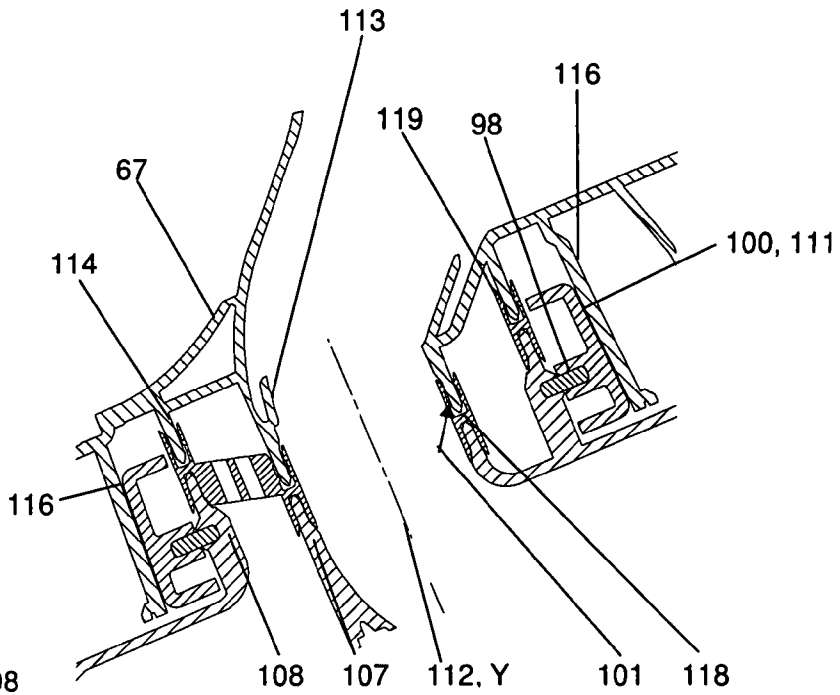
FIGS. 15 and 16 are cross-sectional views through the vacuum cleaner in the region of the swivel joint.
Figure 15:
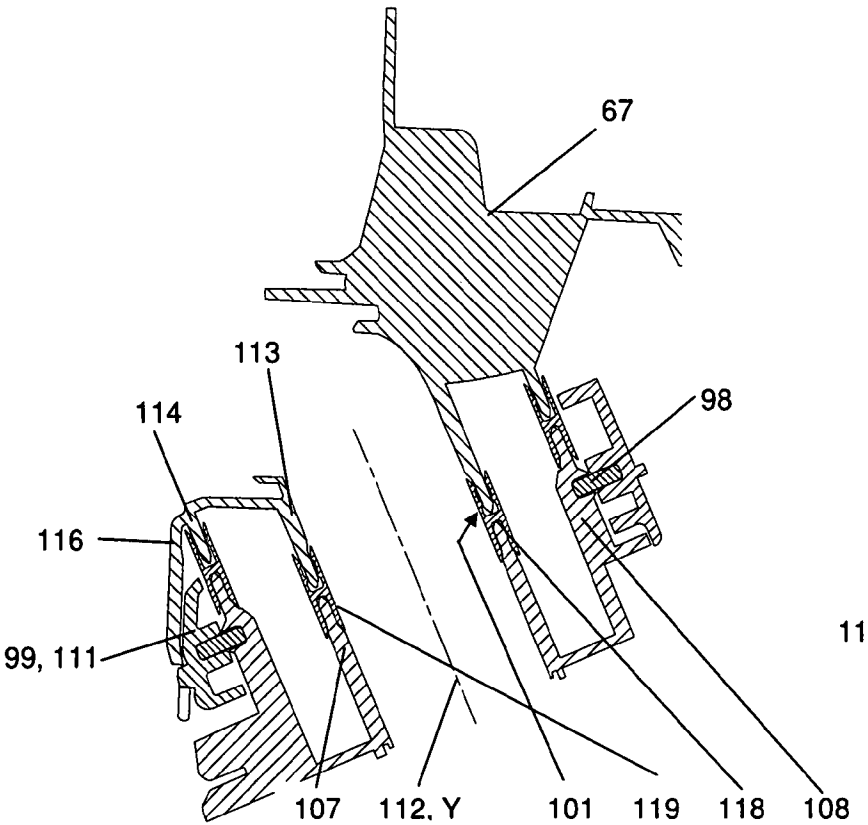

The exploded view of FIG. 12, the isolated view of a portion of the rear wall in FIG. 14, and the cross-sectional views in FIGS. 15 and 16 show that coaxial conduit section 66 from yoke 40 (see FIG. 13) is continued by a second section 87 in rear wall 67. There too, an inner tube 113 is surrounded by an outer annulus 114. The area around section 87 is surrounded by a receiving space 115 defined by a wall 116, which is shown hatched in FIG. 14. After completion of the assembly steps described above, the base unit is inserted with the entire bearing housing 111 into receiving space 115 in a form-locking manner. The cross-sections, in particular on the left in FIG. 15, further show that bearing housing 111 and receiving space 115 are conical in configuration. In this manner, a conical connection is provided between these two parts, forming a press fit. Such a connection is particularly suited to receive the forces which are produced during the tilting and swiveling of upper body 3 and which are transmitted to base unit 2 via yoke 40. This connection is additionally secured in position by screws. When inserting bearing housing 111 into receiving space 115, plug connector 109 is engaged in a plug receptacle 117. Thus, when joining base unit 2 and upper body 3, these two sections are connected both mechanically and electrically.

The two inner tubes 107 and 113, and also the two outer annuli 108 and 114 of coaxial conduit sections 66 and 87, are connected together by seal 101, which features H-shaped cross-sections in each of the two regions. The above-described mounting arrangement is defined such that in the assembled condition, the distances between the ends of outer annuli 108 and 114 and of inner tubes 107 and 113 are larger than the thicknesses of webs 118 of H-shaped seal 101, which are located between the tube ends. Therefore, there are no bearing forces acting on seal 101. Thus, the two sections 66 and 87 can be freely rotated relative to each other. There is only a small resistance resulting from the contact forces of seal walls 119. Since bearing housing 111 is located outside the air passageway, it is prevented from exposure to dirt from the suction air.

The present invention has been described herein based on one or more exemplary embodiments, but is not limited thereto. Reference should be had to the appended claims.

What is claimed is:

1. An upright vacuum cleaner for cleaning a surface, the upright vacuum cleaner comprising:

an upper body having a dust collection container received therein;

a base unit;

a carriage configured to provide movement of the base unit on the surface;

a motor-fan unit disposed in the base unit and configured to create a partial vacuum at the surface; and a rigid, yoke-shaped duct member providing at least a portion of an air path from the base unit to the upper body, the yoke-shaped duct member supporting the upper body such that the upper body is pivotable relative to the base unit about a tilt axis extending horizontally when the upright vacuum cleaner is in a position of use, wherein the yoke-shaped duct member supports the upper body such that the upper body is rotatable with respect to the base unit so as to enable a change in a direction of travel of the base unit by a twisting of the upper body.

2. An upright vacuum cleaner for cleaning a surface, the upright vacuum cleaner comprising:

an upper body having a dust collection container received therein;

a base unit;

a carriage configured to provide movement of the base unit on the surface;

a motor-fan unit disposed in the base unit and configured to create a partial vacuum at the surface; and a rigid, yoke-shaped duct member providing at least a portion of an air path from the base unit to the upper body, the yoke-shaped duct member supporting the upper body such that the upper body is pivotable relative to the base unit about a tilt axis extending horizontally when the upright vacuum cleaner is in a position of use, wherein the yoke-shaped duct member includes a first and a second air conduit extending from respective ends of the duct member to a region of transition to the upper body, the first and second air conduits forming a coaxial conduit at the region of transition.

3. The upright vacuum cleaner as recited in claim 1, wherein the yoke-shape duct member includes a first and a second air conduit extending from respective ends of the duct member to a region of transition to the upper body, the first and second air conduits forming a coaxial conduit at the region of transition.

* * * * *